US009080755B2

(12) United States Patent
Watanabe et al.

(10) Patent No.: US 9,080,755 B2
(45) Date of Patent: Jul. 14, 2015

(54) LIGHTING DEVICE

(75) Inventors: Hiroyuki Watanabe, Osaka (JP); Hisanori Kawasaki, Osaka (JP); Hidemitsu Watanabe, Osaka (JP)

(73) Assignee: APS JAPAN CO., LTD., Osaka (JP)

( * ) Notice: Subject to any disclaimer, the term of this patent is extended or adjusted under 35 U.S.C. 154(b) by 465 days.

(21) Appl. No.: 13/500,726

(22) PCT Filed: Oct. 6, 2010

(86) PCT No.: PCT/JP2010/067568

§ 371 (c)(1), (2), (4) Date: Apr. 6, 2012

(87) PCT Pub. No.: WO2011/043390

PCT Pub. Date: Apr. 14, 2011

(65) Prior Publication Data

US 2012/0195043 A1 Aug. 2, 2012

(30) Foreign Application Priority Data

Oct. 9, 2009 (JP) ..... 2009-235718
Nov. 20, 2009 (JP) ..... 2009-265251

(51) Int. Cl.

| | |
|---|---|
| ***F21V 29/00*** | (2006.01) |
| ***F21K 99/00*** | (2010.01) |
| ***F21V 31/00*** | (2006.01) |
| ***F21V 29/74*** | (2015.01) |
| ***F21V 29/77*** | (2015.01) |
| *F21V 3/00* | (2015.01) |

(Continued)

(52) U.S. Cl.

CPC ..... *F21V 29/004* (2013.01); *F21K 9/135* (2013.01); *F21V 29/74* (2015.01); *F21V 29/773* (2015.01); *F21V 31/005* (2013.01); *F21V 3/00* (2013.01); *F21V 29/83* (2015.01); *F21Y 2101/02* (2013.01)

(58) Field of Classification Search

CPC ..... F21V 29/004; F21V 29/2206; F21V 29/2231; F21V 3/00; F21V 29/74; F21V 29/773; F21V 29/83; F21V 31/005; F21K 9/135; F21Y 2101/02

USPC ..... 362/249.02, 294, 373, 800; 165/80.3

See application file for complete search history.

(56) References Cited

U.S. PATENT DOCUMENTS

| | | | | |
|---|---|---|---|---|
| 7,492,599 | B1 * | 2/2009 | Yu et al. | 362/294 |
| 2011/0221323 | A1 * | 9/2011 | Huang | 313/46 |

FOREIGN PATENT DOCUMENTS

| | | |
|---|---|---|
| JP | 61-182837 | 8/1986 |
| JP | 2005-166578 | 6/2005 |

(Continued)

*Primary Examiner* — Stephen F Husar

(74) *Attorney, Agent, or Firm* — Kratz, Quintos & Hanson, LLP

(57) ABSTRACT

There is provided a lighting device excellent in mass productivity and capable of significantly reducing a production cost and allowing easy provision of a light-weight and large-size lighting device as well as improving a degree of freedom in choosing materials and exhibiting an adequate heat dissipation effect. A heat dissipation portion is obtained by press-working a metal plate. For example, the heat dissipation portion is configured by press-deforming the metal plate into a substantially dome-like shape having a vertically extending peak portion and a vertically extending valley portion that are peripherally and consecutively formed, by repeatedly bending the metal plate along a circumferential direction into a wave shape and concurrently warping the metal plate in an axial direction such that the outer peripheral side of the metal plate is positioned closer to the tip in the axial direction than the central side thereof.

17 Claims, 10 Drawing Sheets

(51) Int. Cl.
*F21Y 101/02* (2006.01)
*F21V 29/83* (2015.01)

(56) References Cited

FOREIGN PATENT DOCUMENTS

| | | |
|---|---|---|
| JP | 2006-313727 | 11/2006 |
| JP | 2007-188832 | 7/2007 |
| JP | 2008-186758 | 8/2008 |
| JP | 2008-293753 | 12/2008 |
| JP | 2009-4130 | 1/2009 |
| JP | 2009-21264 | 1/2009 |
| JP | 2009-43694 | 2/2009 |
| JP | 3151497 | 6/2009 |
| JP | 2009-170114 | 7/2009 |

* cited by examiner (a)

(b)

(a)

(b)

LIGHTING DEVICE

TECHNICAL FIELD

The present invention relates to a lighting device in which a light source portion is provided at a tip portion of a case having a metal heat dissipation portion, and more particularly to a lighting device suitably used as a bulb-type lamp that uses a light emitting device such as an LED. (Light Emitting Diode) as a light source.

BACKGROUND ART

In recent years, the luminous efficiency of an LED is improved and a bulb-type LED lamp for general illumination or decoration is provided. In the bulb-type LED lamp, an LED module on which a plurality of LED devices are mounted and a translucent cover that covers the module are attached to the tip side of a case and light radiated from the LED devices is emitted to the outside, and a base is attached to the base end side of the case via an insulating cover made of a synthetic resin. Since the light output or life of the LED device is reduced at a temperature of 90 degrees or more, a temperature of 50 degrees or less is considered to be appropriate. In addition, a power supply circuit board for the LED accommodated in the case also has a heat-emitting element such as a capacitor or the like, and it is known that, when the temperature of the power supply circuit abnormally rises, there is a possibility that the operational reliability and the life of the circuit are impaired.

To cope with this, in a conventional bulb-type LED lamp, in order to prevent the increase in the temperature of the LED device or the power supply circuit, there is adopted a structure in which a metal heat dissipation portion is provided in a part of a case and heat conducted from the LED device or the power supply circuit is dissipated to the outside (e.g., see Patent Document 1). As the structure of the heat dissipation portion, for example, there are proposed various types each in which there is used an aluminum die cast heat sink formed with a heat dissipation fin having a plurality of grooves on its outer surface, an aluminum plate is placed on the heat sink, and an LED module is disposed on the aluminum plate (see, e.g., Patent Documents 2 to 5).

However, since the conventional heat dissipation portion uses a casting obtained by casting of a metal material using a die, the aluminum die cast heat sink in particular, the thickness of the heat dissipation portion is large, a material cost is increased, and a reduction in weight is limited so that it has been difficult to use the conventional heat dissipation portion in a large-size lighting device. In addition, since a post process after the casting is required, production time is prolonged, and the life of the die is short so that a large-scale production facility has been required for mass production. Further, since the material is limited to a material suitable for casting, there has been a problem that the choice of the material is limited and it is not possible to freely choose a material excellent in thermal conductivity.

Patent Document 1: Japanese Patent Application Laid-open No. 2006-313727

Patent Document 2: Japanese Patent Application Laid-open No. 2009-170114

Patent Document 3: Japanese Patent Application Laid-open No. 2005-166578

Patent Document 4: Japanese Patent Application Laid-open No. 2008-186758

Patent Document 5: Japanese Patent Application Laid-open No. 2009-43694

DISCLOSURE OF THE INVENTION

In view of the above-described situation, an object of the present invention is to provide a lighting device excellent in mass productivity and capable of significantly reducing a production cost and allowing easy provision of a light-weight and large-size lighting device as well as improving a degree of freedom in choosing materials and exhibiting an adequate heat dissipation effect.

In order to solve the above-described problem, the present invention has constituted a lighting device in which a light source portion is provided at a tip portion of a case having a metal heat dissipation portion, wherein the heat dissipation portion is obtained by press-working a metal plate into a shape having a vertically extending peak portion and a vertically extending valley portion that are peripherally and consecutively formed.

Herein, the heat dissipation portion is preferably obtained by press-deforming the metal plate into a substantially dome-like shape having the vertically extending peak portion and the vertically extending valley portion that are peripherally and consecutively formed, by repeatedly bending the metal plate into a wave shape along a circumferential direction and concurrently warping the metal plate in an axial direction such that an outer peripheral side of the metal plate is positioned closer to a tip in the axial direction than a central side of the metal plate.

Additionally, a metal cap to which the light source portion is fixed is preferably attached to a tip opening portion of the heat dissipation portion.

In addition, a bend portion is preferably provided in an outer peripheral portion of the metal cap, an engagement groove is preferably provided in an outer peripheral portion in a vicinity of the opening portion of the heat dissipation portion, and the metal cap is preferably attached to the tip opening portion of the heat dissipation portion by engaging the bend portion with the engagement groove.

Further, the metal cap is preferably placed on the opening portion of the heat dissipation portion in a state where the opening portion is resiliently deformed inwardly and a diameter of the opening portion is thereby reduced, and then the resilient deformation is released in that state, thereby the opening portion having the restored diameter and the metal cap are preferably engaged with each other.

Furthermore, a dustproof gasket is preferably interposed between the metal cap and the tip opening portion of the heat dissipation portion.

Moreover, the light source portion preferably includes an LED module on which a plurality of LED devices are mounted, and a power supply circuit board that is accommodated in an internal space of the heat dissipation portion and turns on the LED devices is preferably supported by the metal cap.

Additionally, the lighting device is preferably constituted as a bulb-type lamp by providing a translucent cover that covers the light source portion on a side of an outer surface of the metal cap to which the light source portion is fixed, and a base on a base end side of the case.

In addition, the present invention has constituted a lighting device in which a light source portion is provided on a tip side of a case having a metal heat dissipation portion, wherein the heat dissipation portion includes a metal tubular main body having one end side to which a support member for the light source portion is attached, and a cooling fin portion that is formed by press-working a plate-like or net-like metal material and is attached to an outer peripheral surface of the tubular main body.

Herein, the support member is preferably formed of a metal plate-like body having an attachment hole in which the one end side of the tubular main body is inserted and fixed, and an inner surface portion of the attachment hole and an entire outer peripheral portion of the one end side of the tubular main body are preferably swaged together to be fixed to each other.

Further, the support member is preferably compressed in an axial direction in a state where a thick portion formed on an entire periphery of an inner peripheral edge of the attachment hole by burring opposes a peripheral groove having a predetermined depth formed in the outer peripheral surface of the tubular main body, and the thick portion is thereby preferably deformed in a direction toward a center of the attachment hole to be engaged into and swaged to the opposing peripheral groove of the tubular main body.

Furthermore, the cooling fin portion is preferably obtained by press-working the plate-like or net-like metal material into a shape having a vertically extending peak portion and a vertically extending valley portion that are peripherally and consecutively formed.

Moreover, the cooling fin portion is preferably formed of the plate-like metal material, and an opening portion that provides communication between the outside and a space formed between an inner surface of the peak portion and the outer peripheral surface of the tubular main body is preferably provided in at least one of a case tip side, a base end side, and a mid portion of the peak portion.

In particular, as the opening portion, a gap is preferably provided between an end edge portion on the case tip side of the peak portion of the cooling fin portion and the support member attached to the one end side of the tubular main body, and the end edge portion is thereby preferably opened to the outside.

Additionally, as the opening portion, a notched groove is preferably provided in a top portion of the mid portion of the peak portion of the cooling fin portion.

In addition, as the opening portion, an end edge portion on the case base end side of the peak portion of the cooling fin portion is preferably opened to the outside.

Further, the cooling fin portion is preferably obtained by press-deforming the plate-like or net-like metal material into a substantially dome-like shape having the vertically extending peak portion and the vertically extending valley portion that are peripherally and consecutively formed, by repeatedly bending the plate-like or net-like metal material into a wave shape along a circumferential direction and concurrently deforming the metal material in an axial direction such that an outer peripheral side of the metal plate is positioned closer to a tip in the axial direction than a central side of the metal plate.

Furthermore, the lighting device is preferably constituted as a bulb-type lamp by providing a translucent cover that covers the light source portion on a side of an outer surface of the support member to which the light source portion is fixed, and attaching a base to a base end side of the tubular main body.

According to the lighting device, the heat dissipation portion is excellent in mass productivity and capable of significantly reducing a production cost as compared with a conventional aluminum die cast heat sink. That is, since the heat dissipation portion is constituted by press working using the metal plate is utilized, a material cost is low so that the total cost can be reduced, the life of a die is long, production time is short, and the production can be efficiently performed as compared with casting using a die. In addition, since the heat dissipation portion is a product formed of the metal plate, the heat dissipation portion is light, and it is possible to easily provide a large-size lighting device. Further, as compared with the conventional aluminum die casting, the use of a material having a high thermal conductivity such as brass or copper can be realized, a degree of freedom in choosing materials is improved, and cost performance for a heat dissipation capability can be improved.

According to the lighting device, since the heat dissipation portion is obtained by press-deforming the metal plate into the substantially dome-like shape having the vertically extending peak portion and the vertically extending valley portion that are peripherally and consecutively formed, by repeatedly bending the metal place into the wave shape along the circumferential direction and concurrently warping the metal plate in the axial direction such that the outer peripheral side of the metal plate is positioned closer to the tip in the axial direction than the central side of the metal plate, the surface area is increased correspondingly to the presence of the similar peak portion and valley portion inside the heat dissipation portion as well so that the heat dissipation effect is significantly improved as compared with the conventional aluminum die cast heat sink. In such bending, the metal plate can be formed into the target shape by bending the metal plate without expansion or contraction, a problem such as tear or a surplus portion can be minimized, the number of production steps is reduced, and a reduction in cost is allowed.

According to the lighting device, since the metal cap to which the light source portion is fixed is attached to the tip opening portion of the heat dissipation portion, it becomes possible to conduct heat generated in the light source portion to the heat dissipation portion through the metal cap, and efficiently dissipate the heat into outside air from the heat dissipation portion. That is, the thermal conduction from the metal cap receiving the heat of the light source portion to the heat dissipation portion is excellent and a cooling capability to the light source portion is excellent. Therefore, an abnormal rise in the temperature of the light source portion is prevented and reductions in the luminous efficiency and the life of the light source portion can be suppressed.

According to the lighting device, since the bend portion is provided in the outer peripheral portion of the metal cap, the engagement groove is provided in the outer peripheral portion in the vicinity of the opening portion of the heat dissipation portion, and the metal cap is attached to the tip opening portion of the heat dissipation portion by engaging the bend portion with the engagement groove, although the metal cap and the heat dissipation portion can be fixed to each other by welding or the like, the metal cap and the heat dissipation portion can be easily joined to each other only by engaging them with each other in this manner, and the production can be efficiently performed. In addition, since the bend portion is engaged so as to cover the outer peripheral portion of the tip opening portion of the heat dissipation portion, it is possible to reliably conduct the heat of the light source portion or the like having been conducted to the metal cap to the heat dissipation portion through the bend portion, and efficiently dissipate the heat.

According to the lighting device, since the metal cap is placed on the opening portion in the state where the opening portion of the heat dissipation portion is resiliently deformed inwardly and the diameter of the opening portion is thereby reduced, and the opening portion having the restored diameter and the metal cap are engaged with each other by releasing the resilient deformation, they can be easily engaged with each other without additionally performing swaging or the like, and the production can be efficiently performed.

According to the lighting device, since the dustproof gasket is interposed between the metal cap and the tip opening portion of the heat dissipation portion, the lighting device has a dripproof function, and can adequately cope with outdoor use. Although it is preferable to use a material excellent in thermal conductivity as the above-described dustproof gasket, in the case of the metal cap having the above-described bend portion, since the heat can be conducted to the heat dissipation portion through the bend portion, the dustproof gasket is not limited to the material excellent in thermal conductivity.

According to the lighting device, since the light source portion includes the LED module on which the plurality of the LED devices are mounted, and the power supply circuit board that is accommodated in the internal space of the heat dissipation portion and turns on the LED devices is supported by the metal cap, the heat in the LED device or the power supply circuit board whose luminous efficiency or life is reduced by an increase in temperature is efficiently dissipated by the heat dissipation portion through the metal cap, and a product capable of maintaining excellent functions as the LED lighting device for a long time period can be provided.

According to the lighting device, the lighting device can be constituted as the bulb-type lamp by providing the translucent cover that covers the light source portion on the side of the outer surface of the metal cap to which the light source portion is fixed, and the base on the base end side of the case. In particular, in a lighting device having the light source portion constituted by the LED module, dimming by the LED can be performed using a current dimmer for a typical incandescent lamp.

According to the lighting device, since the heat dissipation portion is constituted by the metal tubular main body and the cooling fin portion formed by press working, the heat dissipation portion is excellent in mass productivity and is capable of significantly reducing the production cost as compared with the conventional heat sink having the aluminum die cast cooling fin. Particularly, since the cooling fin portion is formed by press working using the plate-like or net-like metal material, as compared with the casting using a die, the material cost is low so that the total cost can be reduced, the life of the die is long, the production time is short, and the production can be efficiently performed. In addition, since the cooling fin portion is a product formed of the plate-like or net-like metal material, the cooling fin portion is light, and can be applied to a large-size lighting device. Further, as compared with the aluminum die casting, the use of a material having a high thermal conductivity such as brass or copper can be realized, a degree of freedom in choosing materials is improved, and cost performance for the heat dissipation capability can be improved.

Further, since the metal tubular main body and the cooling fin portion are constituted separately and the support member for the light source portion is attached to one end side of the tubular main body, as compared with a structure in which the entire heat dissipation portion including the cooling fin is formed from a single metal plate by press working, waterproofing/dripproofing measures for the internal current circuit board or the like can be easily realized by the tubular main body, and the dissipation portion can adequately cope with outdoor use. In addition, since it is not necessary to consider waterproof properties of the cooling fin portion attached to the outer peripheral surface, a degree of freedom in designing such as, e.g., designing a structure capable of taking in outside air into the inside of the fin or the like is enhanced, and the heat dissipation capability can be further enhanced.

According to the lighting device, the heat dissipation portion and the light source portion can be easily fixed to each other, and the heat dissipation effect can be further enhanced. That is, in the case of the lighting device in which the entire heat dissipation portion including the cooling fin is formed from a single metal by press working, there are cases where the structure in which the support member for the light source portion is attached to one end side thereof becomes complicated so that a sufficient contact area cannot be secured. However, in the present invention, since the support member is formed of the metal plate-like body having the attachment hole in which the one end side of the tubular main body is inserted and fixed and the inner surface portion of the attachment hole and the entire outer peripheral portion of the one end side of the tubular main body are swaged together to be fixed to each other, it is possible to secure a sufficient contact area between the support member and the tubular main body, and the thermal conduction from the support member receiving the heat of the source portion to the tubular main body is made excellent. Consequently, after the heat generated in the light source portion is conducted from the support member to the tubular main body, the heat can be efficiently dissipated from the cooling fin portion on the outer peripheral surface of the tubular main body into outside air, an abnormal rise in the temperature of the light source portion is prevented, and reductions in the luminous efficiency and the life of the light source portion can be suppressed.

According to the lighting device, since the support member is compressed in the axial direction in the state where the thick portion formed on the entire periphery of the inner peripheral edge of the attachment hole by burring opposes the peripheral groove having the predetermined depth formed in the outer peripheral surface of the tubular main body, and the thick portion is thereby deformed in the direction toward the center of the attachment hole to be engaged into and swaged to the opposing peripheral groove of the tubular main body, the above-described contact area can be sufficiently secured and, since the thick portion is engaged into the peripheral groove, the thick portion and the peripheral groove can be fixed to each other watertightly, and the waterproof/dustproof function can be enhanced. Further, it is possible to easily realize swaging that maintains sufficient fixing strength at a low cost without forming complicated special shapes in the support member and the tubular main body.

According to the lighting device, since the cooling fin portion is obtained by press-working the plate-like or net-like metal material into the shape having the vertically extending peak portion and the vertically extending valley portion that are peripherally and consecutively formed, as compared with the conventional aluminum die cast heat sink, the surface area is increased correspondingly to the presence of the similar peak portion and valley portion inside the cooling fin portion so that the heat dissipation effect is significantly enhanced. That is, it is possible to efficiently conduct heat collected in the tubular main body from the light source portion via the support member to the cooling fin portion having the large surface area, and efficiently dissipate the heat. In addition, since such cooling fin portion has a structure in which the inner diameter can be slightly increased and reduced by the resilient deformation of the bend portions of the peak portion and the valley portion, by setting the inner diameter to be slightly smaller than the outer diameter of the tubular main body, the cooling fin portion can be easily attached to the outer surface of the tubular main body and, since the cooling fin portion is press-attached to the outer surface by the resilient restoring force, it is possible to easily fix them to each other without additionally performing bonding or welding, and efficiently perform the production.

According to the lighting device, since the cooling fin portion is formed of the plate-like metal material, and the opening portion that provides communication between the space formed between the inner surface of the peak portion and the outer peripheral surface of the tubular main body and the outside is provided in at least one of the case tip side, the base end side, and the mid portion of the peak portion, it is possible to dissipate heat into outside air that circulates from the inner surface of the cooling fin portion having a large surface area with the peak portion and the valley portion through the opening portion, and significantly improve the heat dissipation effect. That is, while the heat is dissipated only from the outer surface side facing outside air in the conventional cooling fin, in the present device, the heat can be dissipated from the inner surface and, as a result, the heat dissipation area is doubled so that the heat dissipation effect is enhanced.

According to the lighting device, since, as the opening portion, the gap is provided between the end edge portion on the case tip side of the peak portion of the cooling fin portion and the support member attached to the one end side of the tubular main body, and the end edge portion is thereby opened to the outside, the opening portion is provided at the position close to the light source portion, and it is possible to efficiently dissipate the heat from the inner surface of the cooling fin portion into outside air that circulates via the gap.

According to the lighting device, since, as the opening portion, the notched groove is provided in the top portion of the mid portion of the peak portion of the cooling fin portion, it is possible to efficiently circulate air from the mid portion to the inner surface side of the cooling fin portion to enhance the heat dissipation effect.

According to the lighting device, since, as the opening portion, the end edge portion on the case base end side of the peak portion of the cooling fin portion is opened to the outside, it is possible to efficiently circulate air from the end edge portion to the inner surface side of the cooling fin portion to enhance the heat dissipation effect.

According to the lighting device, since the codling fin portion is obtained by press-deforming the plate-like or net-like metal material into the substantially dome-like shape having the vertically extending peak portion and the vertically extending valley portion that are peripherally and consecutively formed, by repeatedly bending the plate-like or net-like metal material into the wave shape along the circumferential direction and concurrently deforming the metal material in the axial direction such that the outer peripheral side of the metal plate is positioned closer to the tip in the axial direction than the central side of the metal plate, in such bending, the metal material can be formed into the target shape by bending the plate-like or net-like metal material without expansion or contraction, a problem such as tear or a surplus portion can be minimized, the number of production steps is reduced, and a reduction in cost is allowed.

According to the lighting device, the lighting device can be constituted as the bulb-type lamp by providing the translucent cover that covers the light source portion on the side of the outer surface of the support member to which the light source portion is fixed, and attaching the base to the base end side of the tubular main body.

EXPLANATION OF REFERENCE NUMERALS

Figure 1:
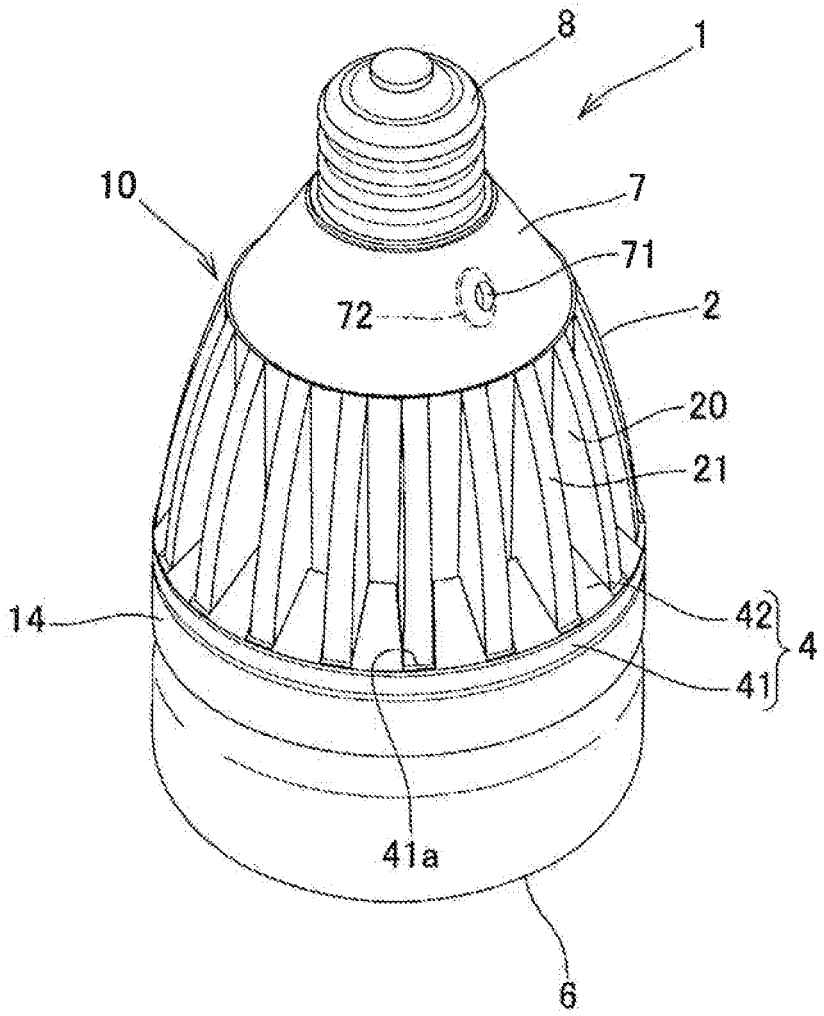
FIG. 1 is a perspective view showing the overall structure of a lighting device according to a first embodiment of the present invention.

1 lighting device
2 heat dissipation portion
2*a* opening portion
3 light source portion
4 metal cap
4A support member
4*a* attachment hole
4*c* inner surface
5 tubular main body
6 cover
6A cooling fin portion
6*a* opening edge portion
6*b* opening portion
7 insulating cover
7A cover
7*a* edge portion
8 base
9 dustproof gasket
9A swaging jig
10 case
11 O ring
12 metal plate
12*a* attachment hole
13 O ring
14 decorative cover
20 valley portion
21 peak portion
21*a* engagement groove
30 LED module
31 LED device
32 support stand
32*a* engagement groove
32*b* protrusion
33 power supply circuit board
33*a* upper end portion
33*b* side end portion
33*c* base end portion
40 thick portion
41 bend portion
41*a* end edge portion
41*b* protrusion
42 sealing piece
43 opening
44 support piece

44*a* vertical groove
45 support plate
46 engagement hole
50 peripheral groove
60 valley portion
61 peak portion
62 end edge portion
63 notched groove
64 end edge portion
70 holding hole
70A ring
71 circulation hole
90 annular portion
90A pressure punch
91 valley filling piece
91A lower support tool
91*a* pressure-receiving surface
92 exterior holding tool

BEST MODE FOR CARRYING OUT THE INVENTION

Next, a detailed description is given of embodiments of the present invention on the basis of the accompanying drawings.

Each of FIGS. 1 to 6 shows a lighting device according to a first embodiment of the present invention, while each of FIGS. 7 to 10 shows a lighting device according to a second embodiment thereof. In the drawings, a reference numeral 1 denotes the lighting device, a reference numeral 2 denotes a heat dissipation portion, a reference numeral 3 denotes a light source portion, and a reference numeral 10 denotes a case. Note that, in the following description, although the description is given of an example where the lighting device of the present invention is constituted as a bulb-type lamp that is provided with a base 8 at a base end side of the case 10 and is used as a downlight or the like, the lighting device of the present invention is not limited to such bulb-type lamp, and can be constituted as various lighting devices such as a non-bulb-type lighting device and the like.

First, on the basis of FIGS. 1 to 6, the first embodiment of the present invention is described.

Figure 2:
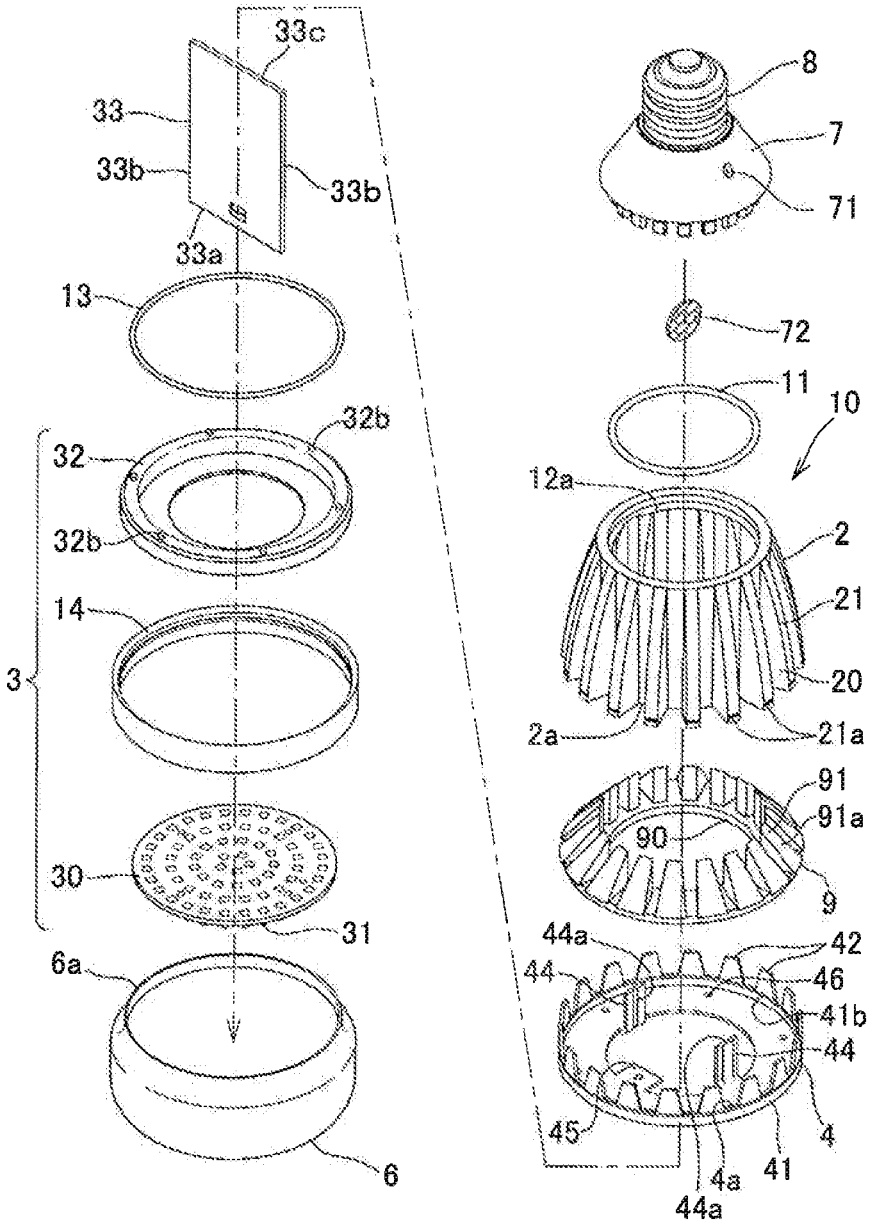
FIG. 2 is an exploded perspective view of the lighting device.

As shown in FIGS. 1 and 2, in the lighting device 1 according to the first embodiment, the light source portion 3 is provided at the tip portion of the case 10 having the metal heat dissipation portion 2 and, in particular, the heat dissipation portion 2 is constituted by press-working a metal plate into a shape having a vertically extending peak portion and a vertically extending valley portion that are peripherally and consecutively formed.

As shown in FIG. 2, a metal cap 4 to which the light source portion 3 is fixed is attached to a tip opening portion 2*a* of the heat dissipation portion 2 in a state where a dustproof gasket 9 is held between the metal cap 4 and the heat dissipation portion 2. In the present embodiment, the light source portion 3 is constituted by an LED module 30 on which a plurality of LED devices 31 are mounted, and the LED module 30 is fixed to the upper surface of the metal cap 4 via a metal support stand 32. With the arrangement, heat generated in the LED devices 31 is conducted to the heat dissipation portion 2 through the support stand 32 and the metal cap 4, and is efficiently dissipated into outside air from the outer surface of the heat dissipation portion 2.

In the present embodiment, although the light source portion constituted by the LCD module 30 is adopted as the light source portion 3, there can be widely adopted light source portions conventionally known as light source portions of lighting devices such as a fluorescent lamp, a halogen lamp constituted by a filament, and, a high intensity discharge lamp (a high pressure sodium lamp, a metal halide lamp (a multi-halogen lamp), a mercury lamp, or the like).

Figure 6:
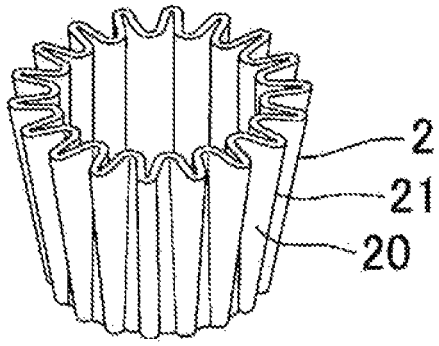
FIG. 6 is an explanatory view showing a press working method of a heat dissipation portion.
Figure 6:
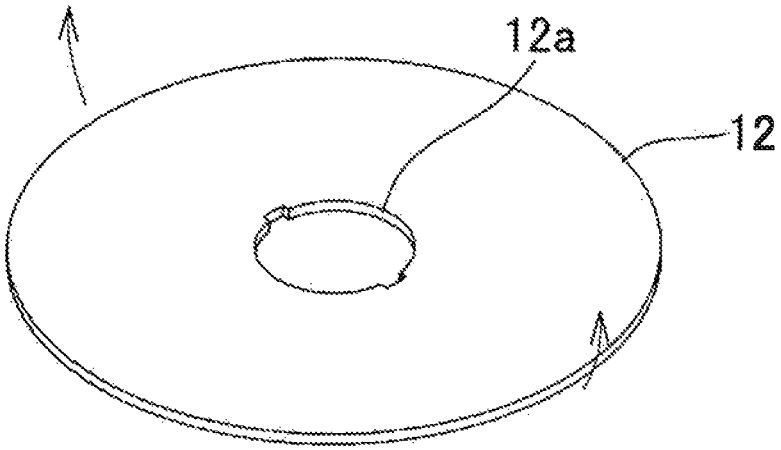

As shown in FIG. 6, the heat dissipation portion 2 constituting the case 10 is constituted by repeatedly bending a metal plate 12 serving as a base shown in FIG. 6(*a*) into a wave shape along a circumferential direction and concurrently warping the metal plate 12 in an axial direction such that the outer peripheral side of the metal plate is positioned closer to the tip in the axial direction than the central side thereof to thereby eventually press-deform the metal plate 12 into a substantially dome-like shape having a vertically extending peak portion 21 and a vertically extending valley portion 20 that are peripherally and consecutively formed, as shown in FIG. 6(*b*).

The metal material for the metal plate 12 is not particularly limited, and it is possible to freely choose a material excellent in thermal conductivity. In the present embodiment, although the metal plate 12 is formed into a substantially conical tapered dome-like shape with a convex outer surface whose diameter is gradually increased from the base end side toward the tip side, the shape is not particularly limited, and there can be adopted various shapes such as a shape whose diameter is gradually reduced from the base end side toward the tip side and a substantially barrel-like shape whose diameter is initially increased and then gradually decreased toward the tip side from the mid portion. In the present embodiment, the uneven shape formed of the peak portion 21 and the valley portion 20 is formed not only on the outer surface but also on the inner surface, and hence inner heat is efficiently conducted and efficiently dissipated from the outer surface into outside air as compared with a conventional die cast heat sink.

As shown in FIG. 6, in the metal plate 12 of the heat dissipation portion 2 before being subjected to press working, an attachment hole 12*a* for the attachment of an insulating cover 7 is preliminarily punched in the central portion serving as the base end side. In a case where a hole for enhancing heat dissipation by facilitating air circulation is formed in the surface of the heat dissipation portion 2, such hole may be preformed in the metal plate 12 before being subjected to press working. In addition, for example, the provision of piping for flowing cold water on the inner surface of the heat dissipation portion 2 or the like to dissipate heat is also a preferred embodiment.

As for the heat dissipation portion 2, although there can be used methods such as cutting (NC machine tool), die machining (machining after extruding), and cold forging other than die casting, the cost of the cutting is high and the material yield thereof is low so that the cutting is not suitable for mass production. The cost of the die machining is also high and the step of removing burrs after the machining is required so that the die machining is not suitable for mass production. The cold forging requires an expensive forging die and an expensive facility, the life of the die is shorter than that in the die casting, and its running cost is high.

Figure 3:
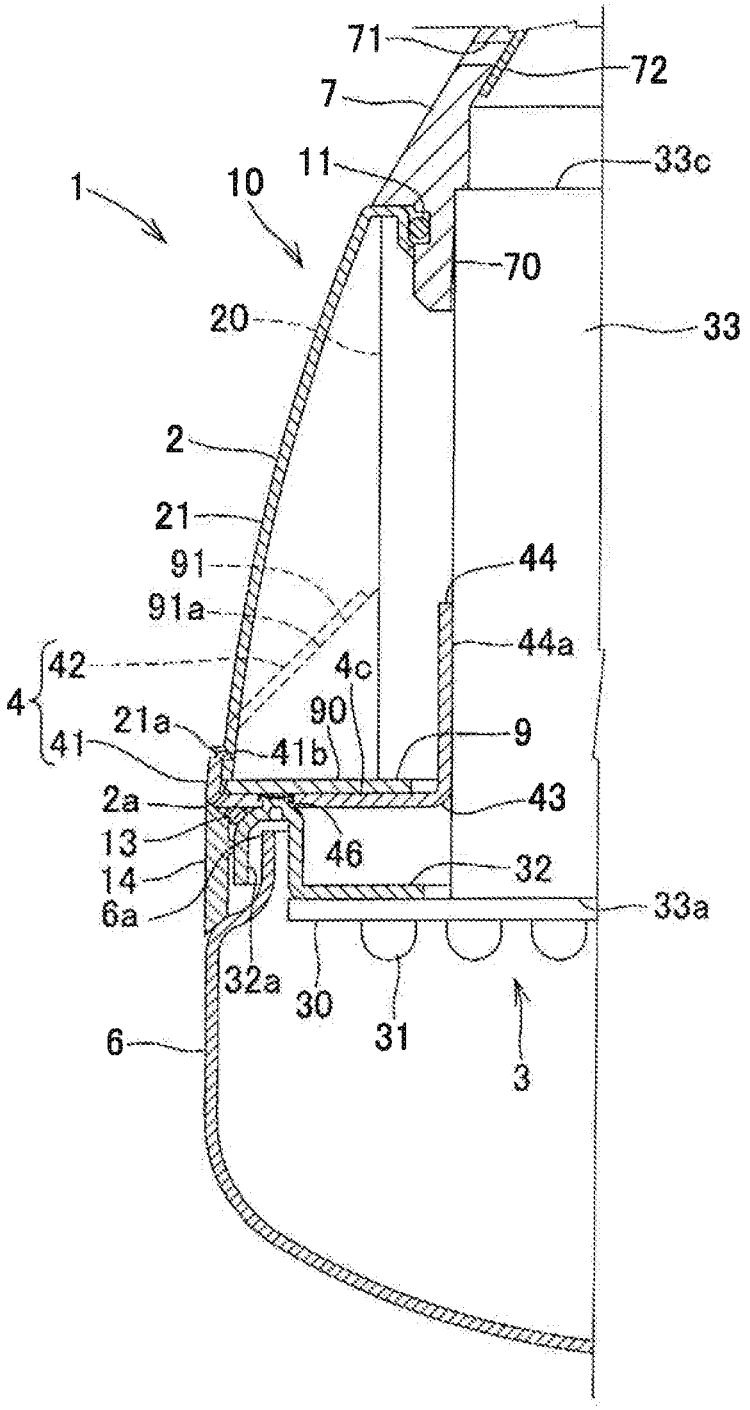
FIG. 3 is a longitudinal sectional view showing the structure of the principal portion of the lighting device.
Figure 4:
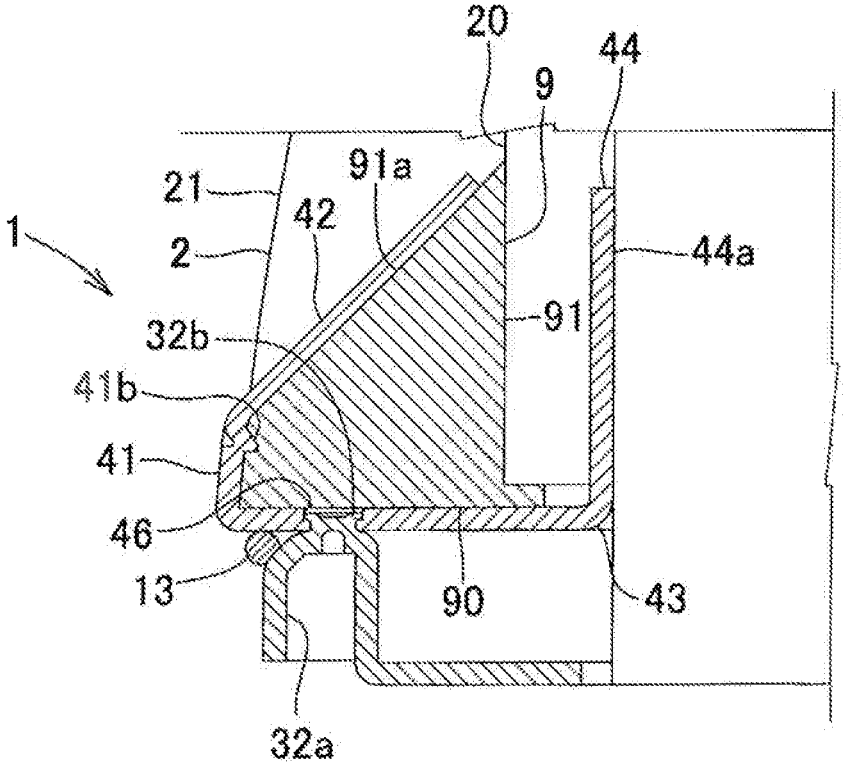
FIG. 4 is a longitudinal sectional view showing the structure of the principal portion thereof.
Figure 5:
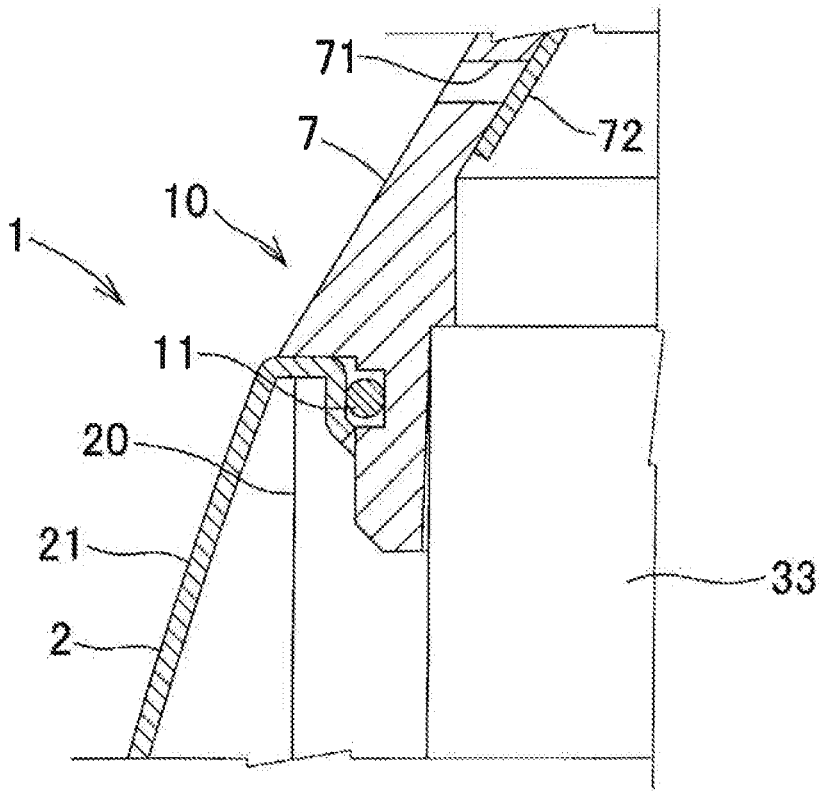
FIG. 5 is a longitudinal sectional view showing the structure of the principal portion thereof.

As shown in FIGS. 2 and 3, the metal cap 4 is provided with a bend portion 41 in its outer peripheral portion, and a protrusion 41*b* is formed on the inner surface of the bend portion 41. On the other hand, in each peak portion on the outer peripheral portion in the vicinity of the opening portion 2*a* of the heat dissipation portion 2, an engagement groove 21*a* is consecutively provided in the circumferential direction. The protrusion 41*b* of the bend portion 41 is engaged with the engagement grooves 21*a*, and the metal cap 4 is thereby attached to the tip opening portion 2*a* of the heat dissipation portion 2. Such metal cap 4 can be easily produced by press-working a metal plate.

As for the attachment of the metal cap 4 to the heat dissipation portion 2, specifically, the metal cap 4 is placed on the opening portion 2*a* in a state where the opening portion 2*a* of the heat dissipation portion 2 is resiliently deformed inwardly and the diameter thereof is thereby reduced, and the deformation is released and the protrusion 41*b* of the metal cap 4 is thereby engaged with the engagement grooves 21*a* of the opening portion 2*a* having the restored diameter, whereby the attachment of the metal cap 4 to the heat dissipation portion 2 can be easily performed. A filler such as an epoxy resin or the like may appropriately be injected into a gap in the engaging portions. It goes without saying that, other than such engagement structure, it is possible to join the metal cap 4 to the heat dissipation portion 2 by welding.

In addition, in the present embodiment, the dustproof gasket 9 is interposed between the metal cap 4 and the tip opening portion 2*a* of the heat dissipation portion 2. Specifically, as described above, the dustproof gasket 9 is attached in the state where the opening portion 2*a* of the heat dissipation portion 2 is resiliently deformed inwardly and the diameter thereof is reduced, and the metal cap 4 is fitted over the dustproof gasket 9 to be engaged. By providing the dustproof gasket 9, although the lighting device can be made suitable as a lighting device for outdoor use, it goes without saying that it is also possible to omit the dustproof gasket. In the present embodiment, with the presence of such dustproof gasket 9, countermeasures against water and soil are taken, the lighting device can be used as the lighting device for outdoor use with no problem, the lighting device can be made usable in case of an emergency by providing a solar cell panel to the lighting device, and the lighting device can also be suitably used as a lighting device for a fishing boat that is used under severe conditions involving a bird feather, garbage, salt water, and dust.

As the material for the dustproof gasket 9, there are used a synthetic rubber, an epoxy resin, and a silicone resin that are excellent in thermal conductivity. In addition, the dustproof gasket 9 of the present embodiment is constituted by an annular portion 90 that is held between the tip opening portion 2*a* of the heat dissipation portion 2 and an inner surface 4*c* on the base end side of the metal cap 4, and a plurality of valley filling pieces 91 that protrude toward the heat dissipation portion 2 from the annular portion 90 and fit in the individual valley portions 20 of the heat dissipation portion 2 to fill spaces formed by the valley portions 20, and has a function of reliably preventing the entry of dust from the valley portions 20.

In addition, in correspondence to the above configuration, in an end edge portion 41*a* of the bend portion 41 of the metal cap 4, a plurality of angular sealing pieces 42 that are bent further inwardly co seal the individual valley portions 20 of the heat dissipation portion 2 are provided along the end edge portion 41*a*, and a flat pressure-receiving surface 91*a* to which the sealing piece 42 is press-attached is provided on the outer surface of each of the valley filling pieces 91 of the dustproof gasket 9. According to such structure, the uneven heat dissipation portion 2 having the peak portions 21 and the valley portions 20 has resilience in a radial direction, and hence the heat dissipation portion 2 can be joined to the metal cap 4 in a state where the dustproof gasket 9 is constantly pressed by the metal cap 4 and the heat dissipation portion 2. However, when the dustproof function and the waterproof or dripproof function are not required, a structure in which the valley filling piece 91 of the dustproof gasket 9 and the sealing piece 42 of the metal cap 4 are omitted and the circulation of air from the valley portion is facilitated is also a preferred embodiment.

In the present embodiment, by making the heat dissipation portion 2 of the case 10 into a metal sheet member (press-worked component) in this manner, a high thermal conductive material (the dustproof gasket 9) can be sandwiched between two metal sheets (the heat dissipation portion 2 and the metal cap 9), and the present embodiment can adopt a structure in which the presence of such high thermal conductive material doubles a heat dissipation capability of heat generated from the inside of the target case 10 or the target LED module 30. The sandwiching of the high thermal conductive material is not possible in aluminum die casting, and the sandwiching thereof is a structure that cannot be realized without the press working of the present invention.

To the outer surface of the tip side of the metal cap 9, a support stand 32 of the LED module 30 is fixed. Specifically, a plurality of divergent engagement protrusions 32*b* are provided on a base end surface in the outer peripheral portion of the support stand 32, engagement holes 96 are provided at positions on the outer surface of the metal cap corresponding to the individual protrusions 32*b*, and the protrusions 32*b* are engaged with the engagement holes 46, whereby it is possible to easily attach the LED module to the metal cap 4 with a single motion without using an adhesive or a screw. According to the bonding structure without using the adhesive or the like, it is possible to efficiently perform the production, provide excellent thermal conduction, and efficiently conduct the heat of the LED module to the metal cap 4. In order to reduce a thermal resistance in a thermal conduction path from the light source portion 3 to the metal cap 4, there may be provided a thermal conductive layer excellent in thermal conductivity between the support stand 32 and the metal cap 4 by filling a thermal conductive element such as silicon or grease therebetween.

Inside the case 10 constituted by the heat dissipation portion 2, there is accommodated a power supply circuit board 33 for turning on the LED devices 31 of the light source portion 3. The power supply circuit board 33 is unitized by attaching various circuit components including a capacitor that are not shown, and a lead electrically connected to the LED device 31 and a covered wire connected to the base 8 are extended from the power supply circuit board 33. A base end portion 33*c* of the power supply circuit board 33 is locked in holding holes 70 at the tip of the insulating cover 7 on the base end side of the case 10, and is thereby placed stably.

In addition, an upper end portion 33*a* of the power supply circuit board 33 is inserted through an opening 43 so as to protrude from the opening 43 formed in the center of the metal. cap 4 toward the tip side, and side end portions 33*b* are held between vertical grooves 44*a* in inner surfaces of a pair of support pieces 44 that are provided to extend from the inner peripheral edge of the opening 43 of the metal cap toward the base end side and are further screwed to a support plate 45 that protrudes inwardly from the inner peripheral edge of the opening 43 of metal cap 4. By holding the power supply circuit board 33 using the metal cap 4 in this manner, it is possible to efficiently guide the heat generated in the capacitor or the like of the power supply circuit board 33 to the heat dissipation portion 2 through the metal cap 4 to dissipate the heat, and prevent an increase in internal temperature to avert reductions in the function and the life of each of the LED module and the board itself. In the present embodiment, the dustproof gasket 9 or the metal cap 4 when the dustproof gasket 9 is omitted is directly in intimate contact with the entire rough annular end surface of the heat dissipation portion 2, and the heat conducted to the metal cap 4 from the LED module 30 or the power supply circuit board 33 is efficiently conducted to the entire heat dissipation portion 2.

On the side of an outer surface (tip surface) 40 of the metal cap 4 to which the LED module 30 is fixed, a translucent cover 6 that covers the LED module 30 is provided. The structure of the cover 6 is not particularly limited. In the present embodiment, although the cover 6 has a substantially spherical surface on its tip side, instead of the spherical shape, a polyhedral surface obtained by combining surfaces of a triangular shape, a polygonal shape, and other shapes may also be used. In addition, it is also possible to use a flat cover, or a cover similar to a cover of the conventional lighting device. The cover 6 is fixed by fitting an opening edge portion 6*a* of the cover 6 in an engagement groove 32*a* formed in the outer peripheral portion of the metal support stand 32 that supports the LED module 30, and filling a gap between the opening edge portion 6*a* and the engagement groove 32*a* with an adhesive. Further, on the outside thereof and between the cover 6 and the metal cap 4, an annular decorative cover 14 made of a synthetic resin is externally attached via an O ring 13 made of a silicone resin, and the gap is covered with the decorative cover 14 such that the gap is not visible from the outside. For example, an ABS resin is used for the decorative cover 14, the outer surface of the decorative cover 14 is chrome plated, and the designability thereof is enhanced.

On the base end side of the heat dissipation portion 2 constituting the case 10, the insulating cover 7 made of a synthetic resin is provided via an O ring 11 made of a silicone resin, the base 8 is attached via the insulating cover 7, and a bulb-type LED lamp is thereby constituted. A circulation hole 71 is formed in the insulating cover 7 and air is circulated through the circulation hole 71 so that heat dissipation is facilitated and the internal humidity is controlled such that condensation does not occur in the cooled power supply circuit board 33 after the lamp is turned off. More specifically, a waterproof moisture-permeable film made of a polytetrafluoroethylene film and a polyurethane polymer ("Gore-Tex" (registered trademark) manufactured by W.L Gore & Associates, Inc.) is stuck to the inner surface side of the circulation hole 71, the moisture is allowed to pass through the circulation hole 71 while the waterproof function is maintained, and the above-described condensation is reliably prevented.

Next, on the basis of FIGS. 7 to 10, the second embodiment of the present invention is described.

Figure 7:
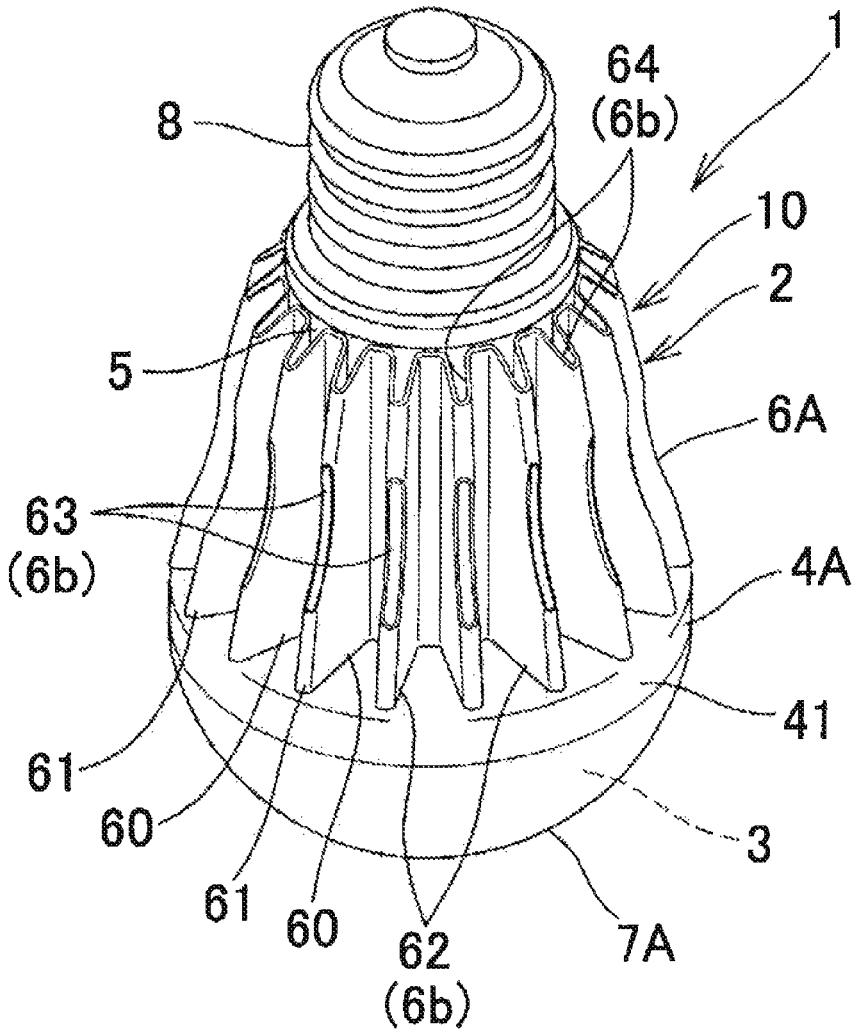
FIG. 7 is a perspective view showing a lighting device according to a second embodiment of the present invention when viewed from a base end side.
Figure 8:
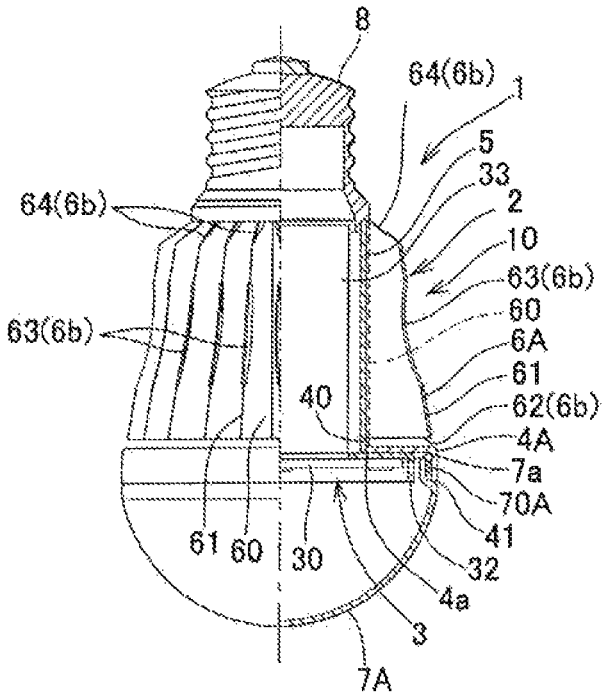
FIG. 8(*a*) is a partial longitudinal sectional view of the lighting device, while FIG. 8(*b*) is an enlarged cross-sectional view of the principal portion.
Figure 8:
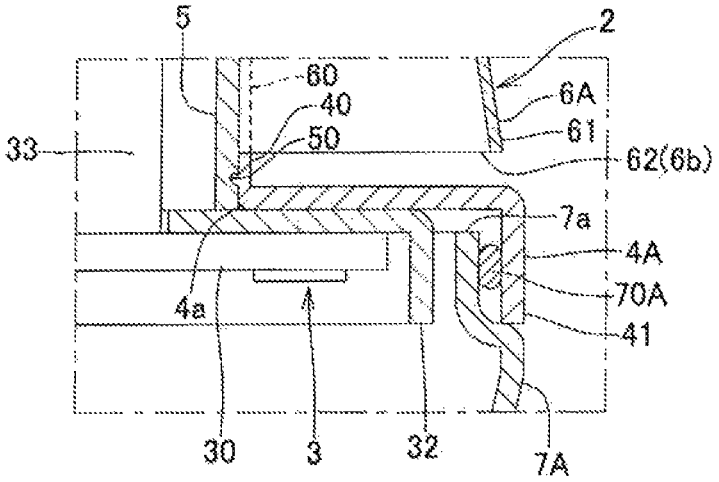
Figure 9:
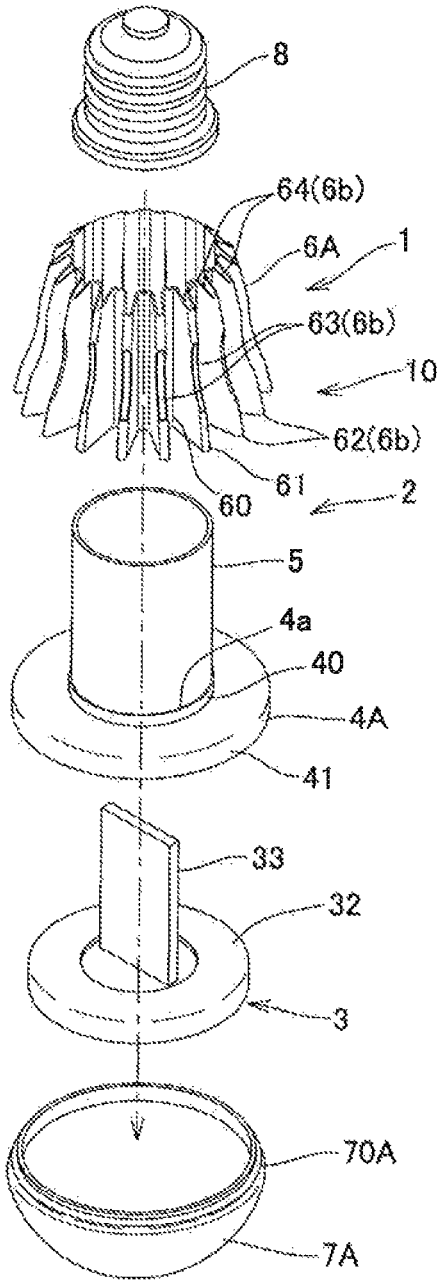
FIG. 9 is an exploded perspective view of the lighting device.

As shown in FIGS. 7 to 9, in the lighting device 1 according to the second embodiment, the light source portion 3 is provided on the tip side of the case 10 having the metal heat dissipation portion 2 and, in particular, the heat dissipation portion 2 is constituted by a metal tubular main body 5 to which a support member 4A for the light source portion 3 is attached on one end side serving as a case tip side, and a cooling fin portion 6A that is attached to the outer peripheral surface of the tubular main body 5. The cooling fin portion 6A is formed by press-working a plate-like metal material.

In the present embodiment, the light source portion 3 is constituted by the LED module 30 on which a plurality of LED devices are mounted and, as shown in FIG. 8, the LED module 30 is fixed to the upper surface of the support member 4A via the metal support stand 32. With the arrangement, heat generated in the LED device is conducted to the tubular main body 5 through the metal support stand 32 and the support member 4A, the heat is efficiently dissipated into outside air from the cooling fin portion 6A fixed to the outer surface side, the heat in the LED device or the power supply circuit board whose luminous efficiency or life is reduced by an increase in temperature is dissipated, and an excellent function as the LED lighting device can be maintained for a long time period. In the present embodiment as well, similarly to the first embodiment described above, other than the LED module 30, light source portions conventionally known as light source portions of lighting devices such as a fluorescent lamp can be widely adopted as the light source portion 3.

The support member 4A is formed of a metal plate-like body having an attachment hole 9*a* in which one end side of the tubular main body 5 is inserted and fixed at the central portion thereof, and the bend portion 91 that is bent toward the tip side is formed by press working in the outer peripheral portion of the support member 9A, and supports an edge portion 7*a* of a translucent cover 7A that covers the LED module 30. Similarly to the above-described first embodiment, the structure of the cover 7A is not particularly limited, and a cover similar to that of the conventional lighting device can be used The cover 7A is fixed with the opening edge portion 7*a* fitted in the inside of the bend portion 91 of the support member 9A via an O ring 70A made of a silicone resin.

As shown in FIG. 8(*b*), in the support member 4A, the inner surface portion of the attachment hole 4*a* and the entire outer peripheral portion on one end side of the tubular main body 5 are swaged together to be fixed to each other. More specifically, a thick portion 40 is formed on the entire inner peripheral edge of the attachment hole 4*a* of the support member 4A by burring, a peripheral groove 50 having a predetermined depth is formed in the outer peripheral surface of the tubular main body 5, the thick portion 40 is compressed in an axial direction by using a device shown in FIG. 10 in a state where the thick portion 40 and the peripheral groove 50 oppose each other, the thick portion 40 is thereby deformed in a direction toward the center of the attachment hole 40 to be engaged into the opposing peripheral groove 50 of the tubular main body, and the thick portion 40 and the circumferential groove 50 are tightly swaged together. As the method of swaging, a method proposed in Japanese Patent Application Laid-open No. 2007-283404 (Japanese Patent Application No. 2007-53670) by the present applicant can be used.

Figure 10:
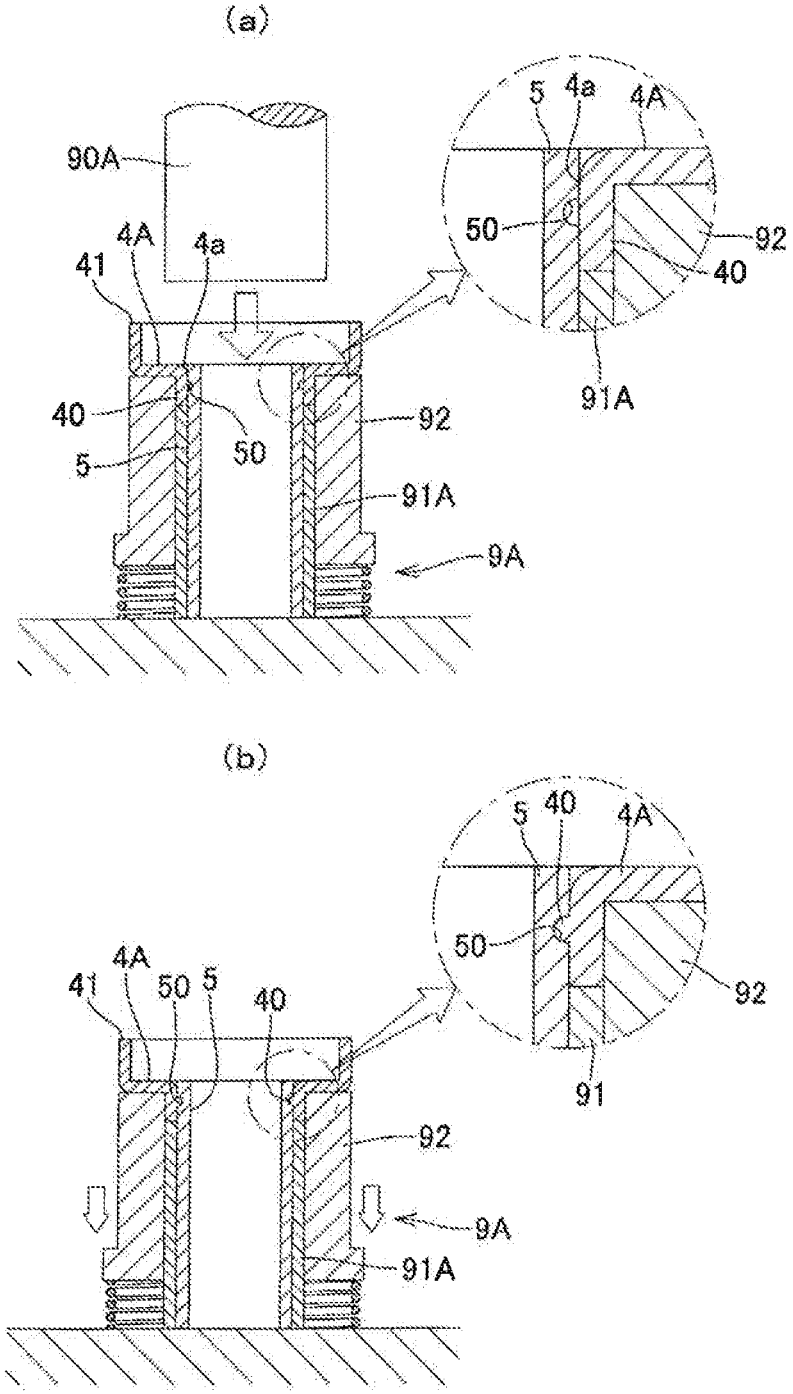
FIG. 10 is an explanatory view showing a method of fixing a support member and a tubular main body to each other.

Specifically, as shown in FIG. 10, the support member 4A is attached to a swaging jig 9A that is constituted by a lower support tool 91A that has an insertion hole allowing the tubular main body 5 to be slidably guided into the internal portion of the lower support tool 91A and comes in contact with and supports the thick portion 40 of the support member 4A from below, and an exterior holding tool 92 that supports the support member 4A while upwardly biasing the support member 4A using a spring in the peripheral portion of the attachment hole 4*a*, the tubular main body 5 is inserted and set in the attachment hole 4*a* of the support member 4A and the insertion hole of the lower support tool 91A with the peripheral groove 50 side positioned on the upper side, and the thick portion 40 and the peripheral groove 5C are thereby caused to oppose each other. The peripheral groove 50 is formed in the vicinity of the end portion of the tubular main body 5, the upper end surface of the tubular main body 5 is set at a position flush with the support member 4A by the swaging jig 9A, and the peripheral groove 50 and the thick portion 40 are set at positions that oppose each other. In the present embodiment, although the thick portion 40 formed by burring is faced downward and the end portion thereof comes in contact with the lower support tool 91A, it goes without saying that the thick portion 40 can be set to face upward.

Subsequently, a pressure punch 90A is pushed down onto the support member 4A and the tubular main body 5 set in the swaging jig 9A from above and the thick portion 40 is compressed between the pressure punch 90A and the lower support tool 91A, whereby the thick portion 40 is deformed in the direction toward the center of the attachment hole and is engaged into the gap in the peripheral groove 50 of the tubular main body 5. Eventually, as shown in FIG. 10(*b*), the internal portion of the peripheral groove 50 is filled with the deformed thick portion 40, and the support member 4A and the tubular main body 5 are tightly fixed to each other integrally.

Although the shape of the attachment hole 4*a* formed with the thick portion 40 of the support member 4A is circular, and the tubular main body 5 is a cube body having the outer peripheral surface having a circular cross section that is inserted into the attachment hole 4*a*, the present invention is not limited to the shapes, and even the tubular main bodies 5 having various cross sections such as, e.g., rectangular or other polygonal cross sections and oblong or other cross sections can be fixed to the support member 4A by forming the attachment holes 4*a* corresponding to the shapes of the tubular main body 5. In addition, the shapes of the tubular main body 5 and the attachment hole 4*a* do not need to match with each other. For example, the combination of the tubular main body 5 having a polygonal cross section and the circular attachment hole 4*a* circumscribing the polygonal cross section, and the combination of the tubular main body 5 having a circular cross section and the polygonal attachment hole 4*a* circumscribing the circular cross section are also preferable. In addition, although the thick portion 40 is formed by raising the hole edge portion in one direction by burring, the thick portion 40 may be formed into other shapes.

Further, in the present embodiment, although the tubular main body 5 is also compressed concurrently, a structure in which the lower end of the tubular main body 5 is supported by being biased using a spring similarly to the support member 4A, and the tubular main body 5 is thereby made movable downward together with the pressure punch 90A so that the tubular main body 5 is not compressed is also a preferred embodiment. Furthermore, the compressing may be performed via a spacer member having a lower end portion being in contact with the thick portion 40, or a tubular portion that comes in contact with only the thick portion may be integrally formed on the lower end of the pressure punch 90A.

The cooling fin portion 6A attached to the outer peripheral surface of the tubular main body 5 is obtained by press-working a plate-like metal material (metal plate) into a shape having a vertically extending peak portion 61 and a vertically extending valley portion 60 that are peripherally and consecutively formed. More specifically, a metal plate serving as a base is repeatedly bent along the circumferential direction into a wave shape, and the metal plate is concurrently deformed in the axial direction such that the outer peripheral side of the metal material is positioned closer to the tip in the axial direction than the central portion of the metal material, whereby the metal plate is press-deformed into a substantially dome-like shape having the vertically extending peak portion 61 and the vertically extending valley portion 60 that are peripherally and consecutively formed, as shown in FIG. 9.

The metal material for the metal plate serving as the base for the cooling fin portion 6A is not particularly limited, and it is possible to freely choose a material excellent in thermal conductivity. In the present embodiment, although the metal plate is formed into the substantially conical taper dome-like shape whose diameter is gradually increased from the base end side toward the tip side, the shape is not particularly limited, and there can be adopted various shapes such as a shape whose diameter is gradually reduced from the base end side toward the tip side and a substantially barrel-like shape whose diameter is initially increased and then decreased toward the tip side from the mid portion. The metal plate may be a metal plate having an opening such as a punched hole or the like, and apart or whole of the cooling fin portion may be constituted by a net-like metal material instead of or in combination with the plate-like metal material. With this, a contact area with outside air is further increased and cooling efficiency is improved.

As for the cooling fin portion 6A, the bend portion formed of the peak, portion 61 and the valley portion 60 is resiliently deformed and the inner diameter of the cooling fin portion inside the valley portion 60 is thereby slightly increased or reduced. Accordingly, by setting the inner diameter to be slightly smaller than the outer diameter of the tubular main body 5 and attaching the cooling fin portion 6A to the outer surface of the tubular main body 5 while deforming the cooling fin portion 6A, the cooling fin portion 6A is press-attached to the outer surface by the resilient restoring force, and they can be easily fixed to each other without additionally performing bonding or welding. The base end side of the cooling fin portion 6A comes in contact with the base 8 attached to the base end side of the tubular main body 5, and the removal of the cooling fin portion 6A is thereby prevented. In the present embodiment, the size of the cooling fin portion 6A in the axial direction is set to be slightly smaller than that of the tubular main body 5 so that a gap is formed such that an end edge portion 62 on the tip side is opened, and only one cooling fin portion 6A is attached to the outer peripheral surface of the tubular main body 5. However, a structure in which a plurality of the cooling fin portions 6A each having a further smaller axial, size are attached to the outer peripheral surface of the tubular main body 5 at intervals in the axial direction is also preferable.

Since the uneven shape formed of the peak portion 61 and the valley portion 60 is formed not only on the outer surface but also on the inner surface of the cooling fin portion 6A, the internal heat can be efficiently conducted and dissipated from the outer surface into outside air efficiently as compared with the conventional die cast heat sink. Further, in the present embodiment, in at least one of the case tip side, the base end side, and the mid portion of the peak portion 61 of the cooling fin portion 6A, there is provided an opening portion 6*b* for providing communication between a, space formed between the inner surface of the peak portion and the outer peripheral surface of the tubular main body and the outside so that the heat can be dissipated into outside air from the inner surface of the cooling fin portion having a large surface area through the opening portion 6*b*, and the heat dissipation effect is significantly improved.

Specifically, as the opening portion 6*b*, a gap is provided between the end edge portion 62 on the case tip side of the peak portion 61 of the cooling fin portion 6A and the support member 4A attached to one end side of the tubular main body and the peak portion end edge portion 62 is thereby opened to the outside, a notched groove 63 is provided in a top portion of the mid portion of the peak portion 61 of the cooling fin portion 6A, and an end edge portion 64 on the case base end side of the peak portion 61 of the cooling fin portion 6A is further opened to the outside. In this manner, the opening portions 6*b* are provided at three (kinds of) positions and the inlet and the outlet of outside air are thereby secured, the inflow of air into the space formed between the inner surface of the peak portion and the outer peripheral surface of the tubular main body is facilitated, and the heat dissipation effect is thereby enhanced. It goes without saying that such opening portion 6*b* may also be provided at one or two positions.

In particular, an opening area of the end edge portion 62 can be increased by obliquely cutting the top portion side thereof or the like. In addition, although the notched groove 63 has an arcuately curved shape in the present embodiment, the present invention is not limited to such shape, and there can be adopted various groove shapes such as a generally V shape and a generally U shape. In addition, the shape of the end edge portion 64 is not particularly limited and, in the present embodiment, the end edge portion 64 has the shape obtained by obliquely cutting the top portion side. However, there can be adopted other shapes. Although these shapes can be processed afterward, the metal plate serving as the base before press working may be subjected to such processing.

The reason why the opening portion 6*b* can be formed in the present embodiment is that the internal waterproof function is maintained by the tubular main body 5 so that, even when the opening portion 6*b* is present in the cooling fin portion 6A, the lighting device can be used as the lighting device for outdoor use with no problem, the lighting device can be made usable in case of an emergency by providing a solar cell panel to the lighting device, and the lighting device can be suitably used as the lighting device for a fishing boat that is used under severe conditions involving a bird feather, garbage, salt water, and dust. Accordingly, the shape of the opening portion 6*b* can be freely designed, and it is also effective to provide a smaller punched hole. Such opening portion 6*b* is not essential. It is also preferable to provide an uneven embossed shape other than the opening portion to increase a surface area. Further, for example, the provision of piping for flowing cold water on the inner surface of the peak portion 61 to dissipate heat is also a preferred embodiment.

To the outer surface on the tip side of the support member 4A, the support stand 32 for the LED module 30 is fixed using an adhesive or a screw. Inside the tubular main body 5, the power supply circuit board 33 for turning on the LED device is accommodated, and is connected to the LED module 30 through the opening portion provided in the center of the support stand 32. The power supply circuit board 33 is unitized by attaching various circuit components including a capacitor that are not shown, and a lead electrically connected to the LED device and a covered wire connected to the base 8 are extended from the power supply circuit board 33.

Thus, although the embodiments of the present invention have been described, the present invention is not limited to the embodiments, and can be carried out in various modes without departing from the gist of the present invention.

The invention claimed is:

1. A lighting device in which a light source portion is provided at a tip portion of a case having a metal heat dissipation portion, wherein the heat dissipation portion is obtained by press-working a metal plate into a shape having a vertically extending peak portion and a vertically extending valley portion that are peripherally and consecutively formed, and the heat dissipation portion is obtained by press-deforming the metal plate into a substantially dome-like shape having the vertically extending peak portion and the vertically extending valley portion that are peripherally and consecutively formed, by repeatedly bending the metal plate into a wave shape along a circumferential direction and concurrently warping the metal plate in an axial direction such that an outer peripheral side of the metal plate is positioned closer to a tip in the axial direction than a central side of the metal plate.

2. The lighting device according to claim 1, wherein a metal cap to which the light source portion is fixed is attached to a tip opening portion of the heat dissipation portion.

3. The lighting device according to claim 2, wherein a bend portion is provided in an outer peripheral portion of the metal cap, an engagement groove is provided in an outer peripheral portion in a vicinity of the opening portion of the heat dissipation portion, and the metal cap is attached to the tip opening portion of the heat dissipation portion by engaging the bend portion with the engagement groove.

4. The lighting device according to claim 3, wherein the metal cap is placed on the opening portion of the heat dissipation portion in a state where the opening portion is resiliently deformed inwardly and a diameter of the opening portion is thereby reduced, and then the resilient deformation is released in that state, thereby the opening portion having the restored diameter and the metal cap are engaged with each other.

5. The lighting device according to claim 2, wherein a dustproof gasket is interposed between the metal cap and the tip opening portion of the heat dissipation portion.

6. The lighting device according to claim 2, wherein the light source portion comprises an LED module on which a plurality of LED devices are mounted, and a power supply circuit board that is accommodated in an internal space of the heat dissipation portion and turns on the LED devices is supported by the metal cap.

7. The lighting device according to claim 2, wherein the lighting device is constituted as a bulb-type lamp by providing a translucent cover that covers the light source portion on a side of an outer surface of the metal cap to which the light source portion is fixed, and a base on a base end side of the case.

8. A lighting device in which a light source portion is provided on a tip side of a case having a metal heat dissipation portion, wherein the heat dissipation portion comprises: a metal tubular main body having one end side to which a support member for the light source portion is attached; and a cooling fin portion that is formed by press-working a plate-like or net-like metal material and is attached to an outer peripheral surface of the tubular main body.

9. The lighting device according to claim 8, wherein the support member is formed of a metal plate-like body having an attachment hole in which the one end side of the tubular main body is inserted and fixed, and an inner surface portion of the attachment hole and an entire outer peripheral portion of the one end side of the tubular main body are swaged together to be fixed to each other.

10. The lighting device according to claim 9, wherein the support member is compressed in an axial direction in a state where a thick portion formed on an entire periphery of an inner peripheral edge of the attachment hole by burring opposes a peripheral groove having a predetermined depth formed in the outer peripheral surface of the tubular main body, and the thick portion is thereby deformed in a direction toward a center of the attachment hole to be engaged into and swaged to the opposing peripheral groove of the tubular main body.

11. The lighting device according to claim 8, wherein the cooling fin portion is obtained by press-working the plate-like or net-like metal material into a shape having a vertically extending peak portion and a vertically extending valley portion that are peripherally and consecutively formed.

12. The lighting device according to claim 11, wherein the cooling fin portion is formed of the plate-like metal material, and an opening portion that provides communication between the outside and a space formed between an inner surface of the peak portion and the outer peripheral surface of the tubular main body is provided in at least one of a case tip side, a base end side, and a mid portion of the peak portion.

13. The lighting device according to claim 12, wherein as the opening portion, a gap is provided between an end edge portion on the case tip side of the peak portion of the cooling fin portion and the support member attached to the one end side of the tubular main body, and the end edge portion is thereby opened to the outside.

14. The lighting device according to claim 12, wherein as the opening portion, a notched groove is provided in a top portion of the mid portion of the peak portion of the cooling fin portion.

15. The lighting device according to claim 12, wherein as the opening portion, an end edge portion on the case base end side of the peak portion of the cooling fin portion is opened to the outside.

16. The lighting device according to claim 11, wherein the cooling fin portion is obtained by press-deforming the plate-like or net-like metal material into a substantially dome-like shape having the vertically extending peak portion and the vertically extending valley portion that are peripherally and consecutively formed, by repeatedly bending the plate-like or net-like metal material into a wave shape along a circumferential direction and concurrently deforming the metal material in an axial direction such that an outer peripheral side of the metal plate positioned closer to a tip in the axial direction than a central side of the metal plate.

17. The lighting device according to claim 8, wherein the lighting device is constituted as a bulb-type lamp by providing a translucent cover that covers the light source portion on a side of an outer surface of the support member to which the light source portion is fixed, and attaching a base to a base end side of the tubular main body.

* * * * *